US007316194B1

(12) United States Patent
Shen et al.

(10) Patent No.: US 7,316,194 B1
(45) Date of Patent: Jan. 8, 2008

(54) RUDDERS FOR HIGH-SPEED SHIPS

(75) Inventors: Young T. Shen, Potomac, MD (US); Edward S. Ammeen, Alexandria, VA (US); Scott Gowing, North Potomac, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/602,439

(22) Filed: Nov. 6, 2006

Related U.S. Application Data

(63) Continuation-in-part of application No. 11/126,511, filed on May 9, 2005, now Pat. No. 7,144,282.

(51) Int. Cl.
*B63H 25/06* (2006.01)

(52) U.S. Cl. ..... 114/163

(58) Field of Classification Search ..... 114/162, 114/163

See application file for complete search history.

(56) References Cited

U.S. PATENT DOCUMENTS 3,179,081 A * 4/1965 Backhaus et al. ..... 440/5
3,412,703 A * 11/1968 Clark et al. ..... 114/163
3,934,538 A * 1/1976 Canazzi ..... 440/43
4,421,489 A * 12/1983 Van Veldhuizen ..... 440/37
4,771,717 A * 9/1988 Cruson ..... 114/163
4,895,093 A * 1/1990 Dalsbo ..... 114/163
5,415,122 A * 5/1995 Shen ..... 114/162
5,456,200 A 10/1995 Shen
5,505,640 A * 4/1996 Angulo ..... 440/43
6,361,385 B1 3/2002 Bland et al.
6,745,715 B1 6/2004 Shen et al.
6,976,445 B1 * 12/2005 Arneson ..... 114/315
7,101,235 B2 * 9/2006 Baldwin ..... 440/37

OTHER PUBLICATIONS

V. P. Bingham and Thomas P. Mackey, High-Performance Rudders -with Particular Reference to Schilling Rudder, Marine Technology, vol. 24, Oct. 1987, pp. 312-320.

* cited by examiner

*Primary Examiner*—Stephen Avila
(74) *Attorney, Agent, or Firm*—Dave A. Ghatt

(57) ABSTRACT

A high-speed water vessel including a steering arrangement for reducing cavitation and its effects. The arrangement includes a twisted rudder pair located downstream of a high-speed propulsor. The rudder pair may also be contoured at a bottom portion thereof. The propulsor has at least one propeller having a propeller diameter. In operation, the propulsor produces a slipstream that contracts with distance from the propeller. To avoid the effects of cavitation, the twisted rudder pair is positioned outside and adjacent to the slipstream diameter, with the rudders of the rudder pair separated by a distance that is less than the diameter of the propellers. The rudders of the rudder pair may be in a substantially parallel orientation with respect to each other. In gas turbine applications, the rudder pairs may be rotated towards each other to produce a rudder bucket for producing a negative thrust for stopping the high-speed water vessel.

20 Claims, 9 Drawing Sheets

RUDDERS FOR HIGH-SPEED SHIPS

This application is a continuation-in-part of application, U.S. patent application Ser. No. 11/126,511 entitled "CONTOURED RUDDER MANEUVERING OF WATERJET PROPELLED SEA CRAFT", filed May 9, 2005, now U.S. Pat. No. 7,144,282 issued Dec. 5, 2006, which is incorporated herein by reference.

FIELD OF THE INVENTION

The present invention relates generally to a high-speed water vessel, more particularly, a steering arrangement in a high-speed water vessel for reducing or eliminating cavitation and its effects.

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

Currently, ships or sea vessels that are commercially utilized in the marine industry and U.S. Navy are propelled by waterjets discharged into the air above the water surface, and by propulsors that provide thrusting forces based on the rotation of propellers. The Navy is constantly searching for advanced technology to build high-speed ships. With the recent advance in hydrodynamic theories of ship resistance, hull form design methods and advanced propulsion technology, the Navy is developing high-speed ships with sprint/transient speeds of 38 to 45 knots. In the first phase of development, waterjet propulsion systems have been selected for high-speed ships.

Propeller drive systems are also being developed for high-speed ships. Typical surface ship propellers are limited to a maximum speed of 35 knots due to propeller cavitation and thrust breakdown. At full power, the ship speeds of most naval surface water vessels are in the order of 30 knots. However, propellers with advaced blade sections have been developed recently to achieve efficient operations at higher speeds. Twisted rudders have been successfully designed to avoid cavitation on the existing surface water vessels up to ship speeds of about 35 knots. At speeds above 35 knots, even twisted rudders may experience cavitation and erosion problems. The design technology of twisted rudders so successfully developed for existing surface water vessels that travel at speeds up to 35 knots, may not be adequate for speeds that exceed 35 knots. A rudder design for high-speed ships that avoids or reduces the effects of caviation and erosion is required.

Additionally, as opposed to waterjet propulsion system slipstreams, slipstreams produced by rotating propellers include rotational and tangential vectors. These vectors can be attributed to the rotational movement of the propellers. Consequently the rudders must also be designed to compensate for these variations in slipstream flow, particularly in high-speed environments.

SUMMARY OF THE INVENTION

The present invention addresses aspects of problems outlined above. Preferred embodiments of the present invention provide an apparatus for guiding a high-speed water vessel, whilst reducing the cavitation effects.

In one aspect, the invention is a high-speed water vessel having a hull with an underside. The apparatus includes at least one high-speed propulsor attached to the underside of the hull, with the at least one high-speed propulsor having one or more propellers. In this high-speed water vessel, the one or more propellers have a propeller diameter, and the one or more propellers generate a propeller slipstream downstream of the at least one high-speed propulsor. In this aspect, the slipstream has a slipstream diameter. In the high-speed water vessel, at least one twisted rudder pair is located downstream of the at least one high-speed propulsor, with the rudder pair rotatably mounted within a zone of effectiveness. According to the invention, the zone of effectiveness is the region within the downstream projection of the propeller diameter that lies outside the slipstream diameter profile. The invention further includes a controller for controlling the rotation of the at least one twisted rudder pair. The controller rotates the at least one twisted rudder pair so that portions of the rudder pair rotate from a position outside the slipstream diameter to a position within the slipstream diameter.

In another aspect, the invention is a steering arrangement mounted to a high-speed ship with a hull. The steering arrangement includes a propulsion system attached to the hull, the propulsion system having at least one high-speed propulsor having at least one propeller. In this aspect the at least one propeller has a propeller diameter, and the propeller generates a slipstream downstream of the propulsion system. Additionally, the slipstream has a slipstream diameter. The steering arrangement has at least one pair of twisted rudders that are rotatably attached to the hull. In this aspect the at least one pair of twisted rudders are positioned downstream of the at least one high-speed propulsor of the propulsion system. The rudders are positioned in a substantially parallel spaced relationship so that the pair of rudders are positioned adjacent to and outside the slipstream diameter but separated by a distance that is less than the propeller diameter.

BRIEF DESCRIPTION OF DRAWINGS

A more complete appreciation of the invention and many of its attendant advantages will be readily appreciated as the same becomes better understood by reference to the following detailed description when considered in connection with the accompanying drawing wherein.

DETAILED DESCRIPTION

Figure 1A:
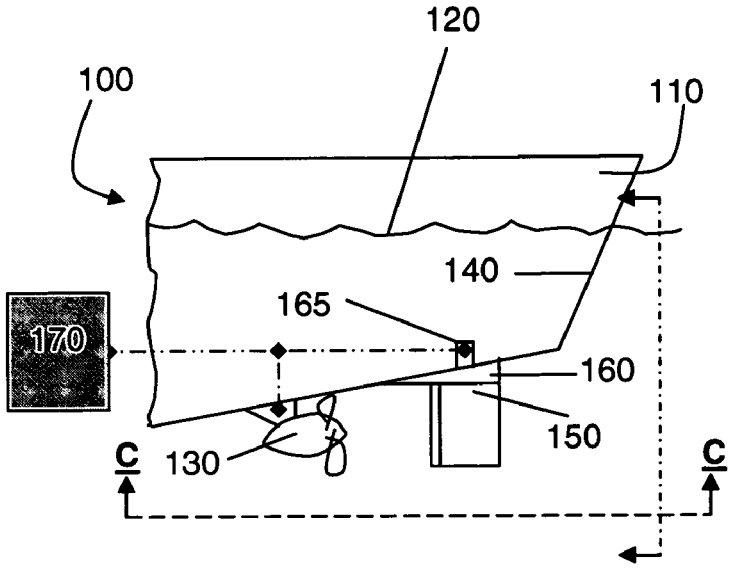
FIG. 1A is a side elevation view of the stern end portion of a high-speed water vessel including a steering arrangement in accordance with an embodiment of the present invention.
Figure 1B:
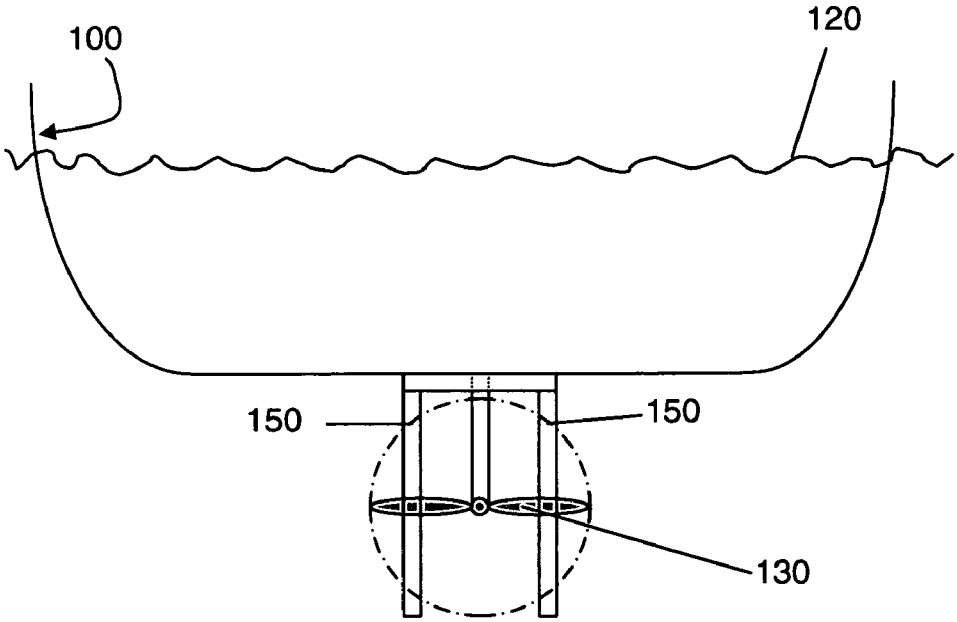
FIG. 1B is a partial front elevation view of the stern end portion of the high-speed water vessel shown in FIG. 1A, as viewed from section line B-B.
Figure 1C:
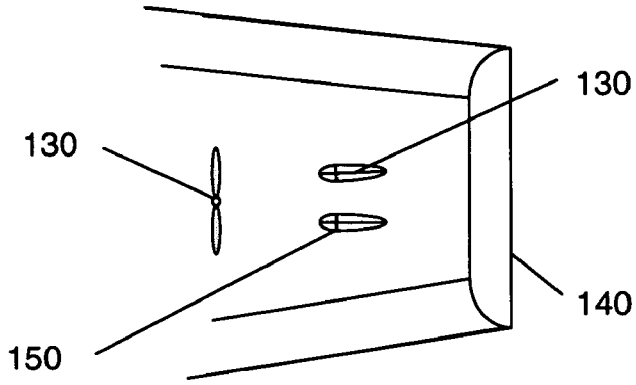
FIG. 1C is a partial bottom plan view of the stem end portion of the high-speed water vessel shown in FIG. 1A, as viewed from section line C-C.

FIGS. 1A, 1B, and 1C illustrate one embodiment of a high-speed water vessel steering arrangement. FIG. 1A shows a surface water vessel 100 having a hull 110 immersed in water 120 and extending vertically above the water surface during normal forward travel. A propulsor 130 is positioned underwater on a bottom portion of the hull 110 closely spaced from its stem end 140. Rudders 150 of a pair of twisted rudders are mounted, via a seat 160, to the bottom of the hull 110 between the stem end 140 and the propulsor 130. FIG. 1A also shows an adjustment member 165 mounted inside the ship for turning the rudders 150.

FIGS. 1A-1C show the rudders 150 of the pair of twisted rudders downstream of the propulsor 130. The propulsor 130 may be an electrical propeller engine, a gas turbine engine, combinations thereof, or any other known propeller engine. The propulsor 130 is designed to propel the water vessel 100 at a sprint/transient speed of about 40 knots to about 55 knots. FIG. 1A shows a maneuvering control 170 connected to propulsor 130 and the adjustment member 165 for automatically controlling the steering of the water vessel. The maneuvering control 170 is part of a ship controller that controls the overall operations of the high-speed ship. The adjustment member 165 may include turning bars and may be mechanically attached to the rudders 150 to enable concurrent turning or adjustment of the rudders. Alternatively, the adjustment member 165 may use separate mechanisms to enable both rudders 150 of the pair of twisted rudders to turn independent of each other.

Figure 1D:
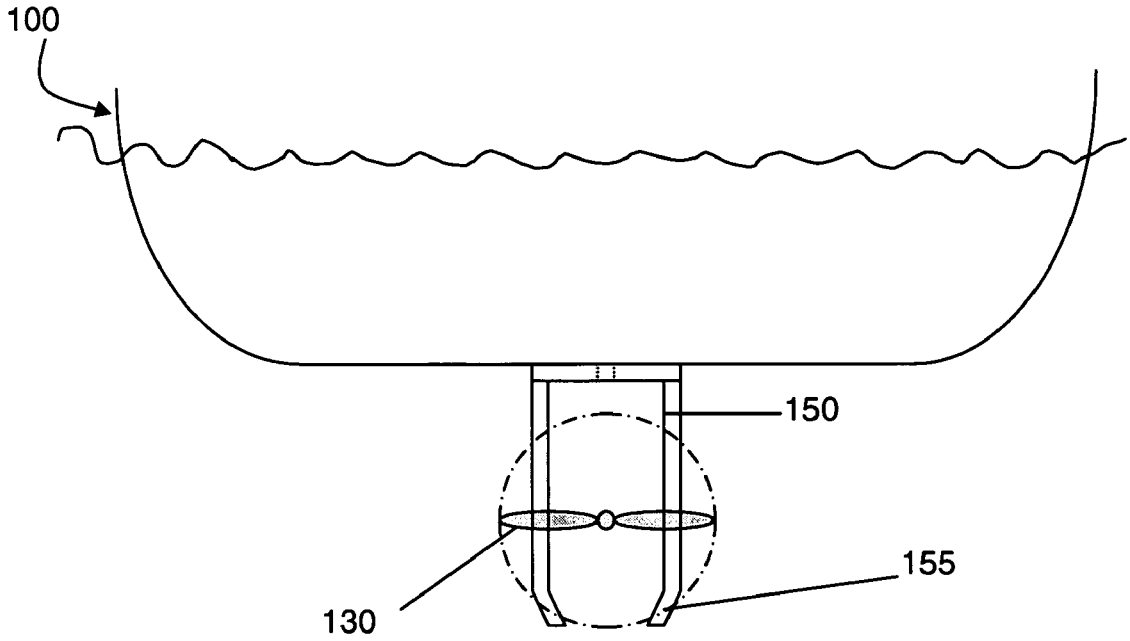
FIG. 1D is a partial front elevation view of the stem end portion of the high-speed water vessel, according to another embodiment of the invention.

FIG. 1D shows an embodiment of a high-speed water vessel steering arrangement, similar to that of FIGS. 1A-1C. However, the rudders 150 of the rudder pair each include a contoured bottom portion 155. As would be explained below, the contoured rudder design is used in gas turbine engines to help create a braking force on the high-speed ship. For the sake of simplicity, FIGS. 1A-1D each show only one propulsor and only one pair of twisted rudders, however a surface water vessel 100 may include two or more propulsors and accompanying rudder pairs.

Figure 2A:
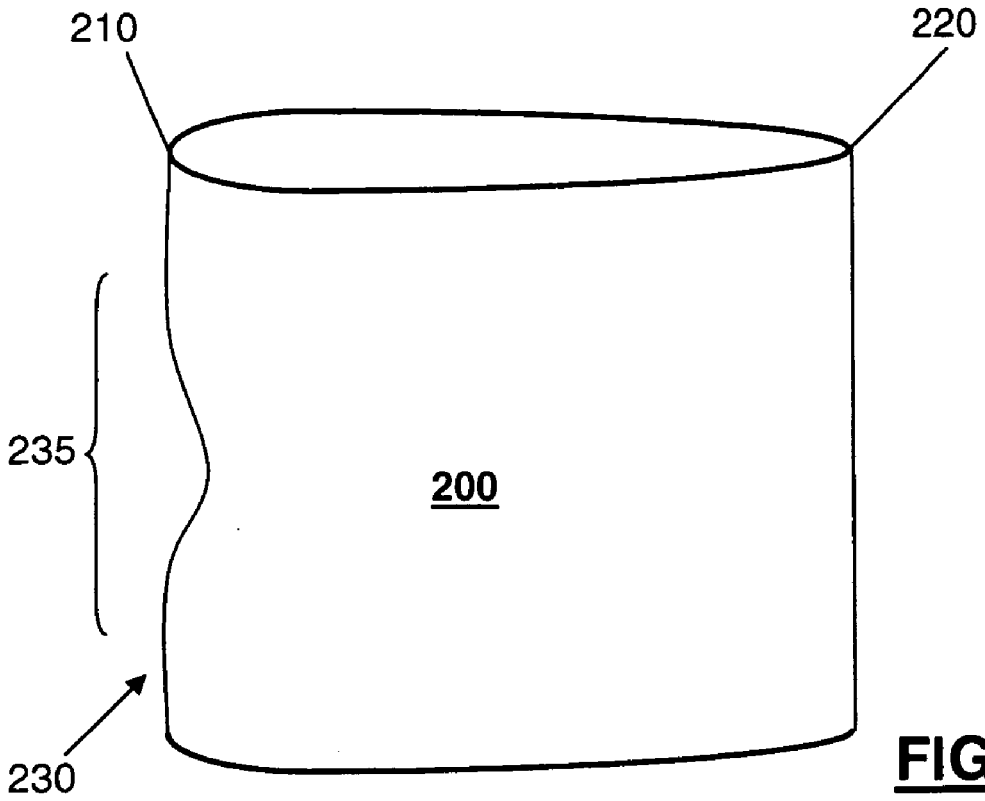
FIG. 2A is a perspective view of a rudder in accordance with an embodiment of the present invention.
Figure 2B:
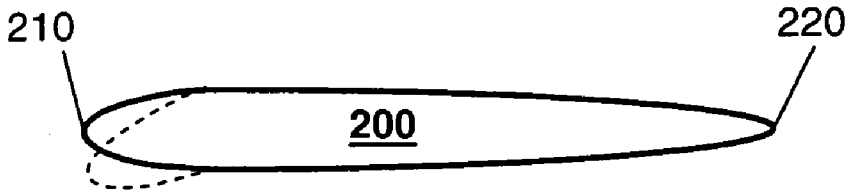
FIG. 2B is a perspective view of a rudder in accordance with an embodiment of the present invention.

FIGS. 2A and 2B are perspective views of a rudder 200 in accordance with an embodiment of the present invention. The rudders of FIGS. 2A and 2B may be used in the arrangement shown in FIGS. 1A-1C to produce benefits as outlined below. FIGS. 2A and 2B show the rudder having a leading edge 210 and a trailing edge 220, with the rudder having a streamlined formation from the leading edge to the trailing edge along the body of the rudder. FIG. 2A shows a longitudinal portion 230 of the leading edge. The longitudinal portion 230 is twisted at a substantially central location 235 along the longitudinal portion. In FIG. 2B, the dotted line shows the change in shape of the rudder along the leading edge. This change in shape is a result of the twisted design, which is implemented at a substantially central location along the longitudinal portion 230. The twisted leading edge design accommodates for the rotational and tangential vectors associated with the slipstream generated by the propulsor 130.

Figure 2C:
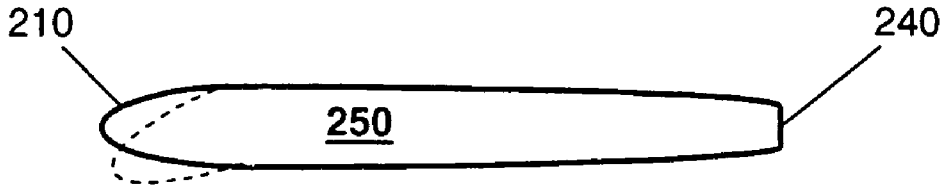
FIG. 2C is a perspective view of a rudder in accordance with another embodiment of the present invention.
Figure 2D:
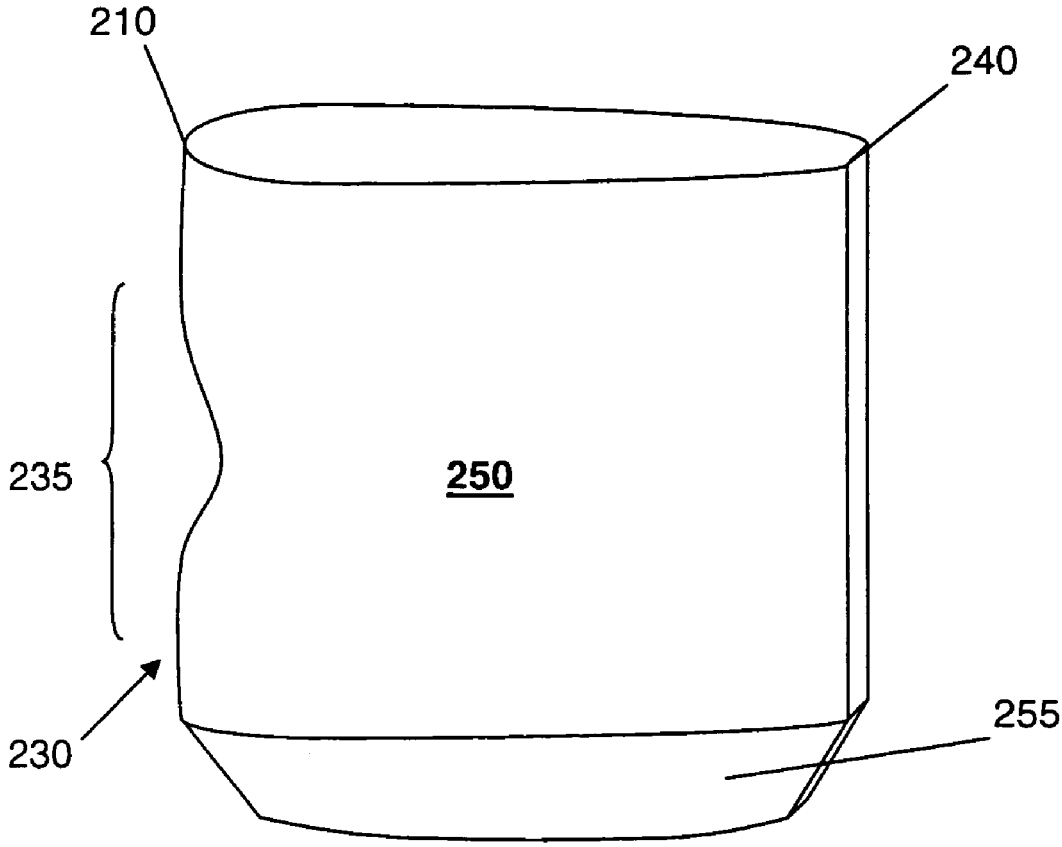
FIG. 2D is a perspective view of a rudder in accordance with another embodiment of the present invention.

FIGS. 2C and 2D show another embodiment of a rudder 250 that may be used in a rudder pair for steering the vessel 100. The rudder of FIGS. 2C and 2D may be used in the arrangement shown in FIG. 1D to produce benefits as outlined below. The rudder 250 has a leading edge 210 and a trailing edge 240, with the rudder having a streamlined formation from the leading edge to the trailing edge along the body of the rudder. However, the trailing edge 240 of the rudder 250 is blunted as opposed to a sharp edge. Similar to the embodiments of FIGS. 2A and 2B, the FIG. 2C rudder has a longitudinal portion 230 that is twisted at a substantially central location 235 along the longitudinal portion. FIG. 2D shows the rudder 250 having a contoured bottom portion 255. In operation, rudders 250 of a rudder pair are arranged so that the contoured bottom portions face each other, similar to the illustration of FIG. 1D. As would be outlined below, the contoured bottom portions 255 are essential to the production of a negative thrust to slow down and stop the high-speed ship.

The rudders of FIGS. 2A-2D may comprise of steel, composite materials, and combinations thereof. The rudders may be sized according to considerations such as, vessel size, speed of the vessel, rudder drag, turning capability, and directional stability. Depending on the size, the rudders may also comprise a steel skeleton frame with core material forms made of polyurethane for filling the general structure around the steel frame.

Figure 3A:
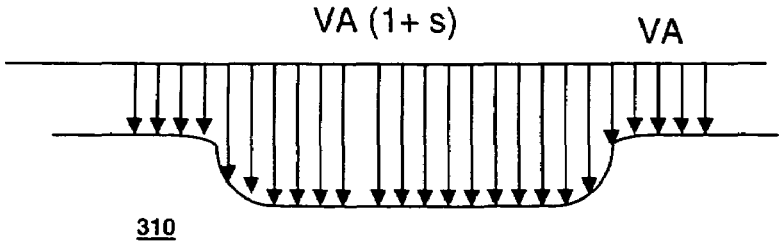
FIG. 3A is a perspective view of a slipstream velocity profile of a high-speed propulsion unit in accordance with an embodiment of the present invention.
Figure 3B:
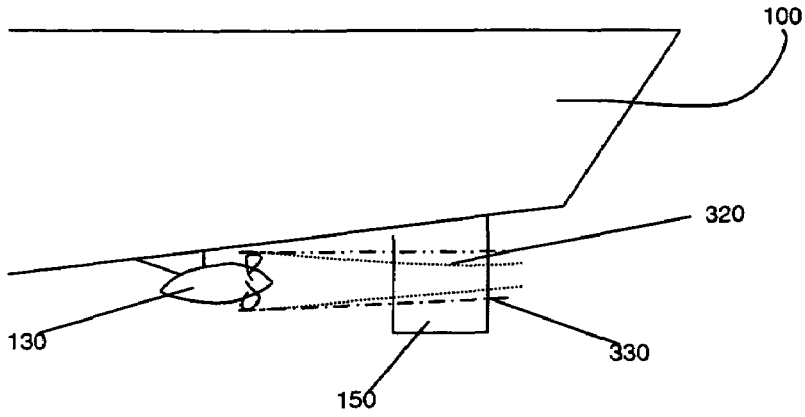
FIG. 3B is a perspective view of a slipstream diameter profile of a high-speed propulsion unit in accordance with an embodiment of the present invention.

FIG. 3A is a perspective view of a slipstream velocity profile 310 of a high-speed propulsor in accordance with an embodiment of the present invention. FIG. 3B is a perspective view of a slipstream diameter profile of a high-speed propulsor in accordance with an embodiment of the present invention. A determination of the slipstream profile is essential to the determination of positioning of the rudders. FIGS. 1A-1D show rudders 150 of a rudder pair located downstream of the propulsor 130, however the exact positioning of the rudder is determined by the velocity, size, and location of the slipstream generated by the propulsor 130.

The slipstream velocity profile for the high-speed propulsor 130 is determined using a momentum theory, and is represented by the equation (1):

$$V_A(1+s)=V_A\sqrt{(1+C_T)} \quad (1)$$

According to the formula, $V_A$ denotes the ship speed and $C_T$ denotes the propeller thrust coefficient. The s denotes the slip ratio downstream of the propeller. At a ship speed of 45 knots for example, with a typical thrust coefficient of 0.5, the slip stream velocity is obtained by: $V_A(1+s)=45\sqrt{(1+0.5)}=55$ knots A sketch of the velocity distribution in an axial direction behind a propeller propulsor is shown in FIG. 3A, with the ship speed denoted by $V_A$ and slip stream velocity by $V_A(1+s)$.

The slipstream diameter profile downstream the high-speed propulsor 130 is determined using the following continuity equation (2):

$$D_r = D_p\sqrt{[1+\sqrt{(1+C_T)}]/[2\sqrt{(1+C_T)}]} \quad (2)$$

According to the equation, $D_p$ denotes the propeller diameter, $D_r$ denotes the slipstream diameter, and $C_T$ denotes the propeller thrust coefficient. From this equation it can be seen that the propeller slipstream experiences contraction downstream of the propulsor. FIG. 3B illustrates, in an exaggerated manner, the slipstream diameter profile 320, showing the variation of the diameter $D_r$ with distance from the propeller. As illustrated, the diameter profile 320 is within the downstream projection 330 of the propeller diameter.

Figure 4A:
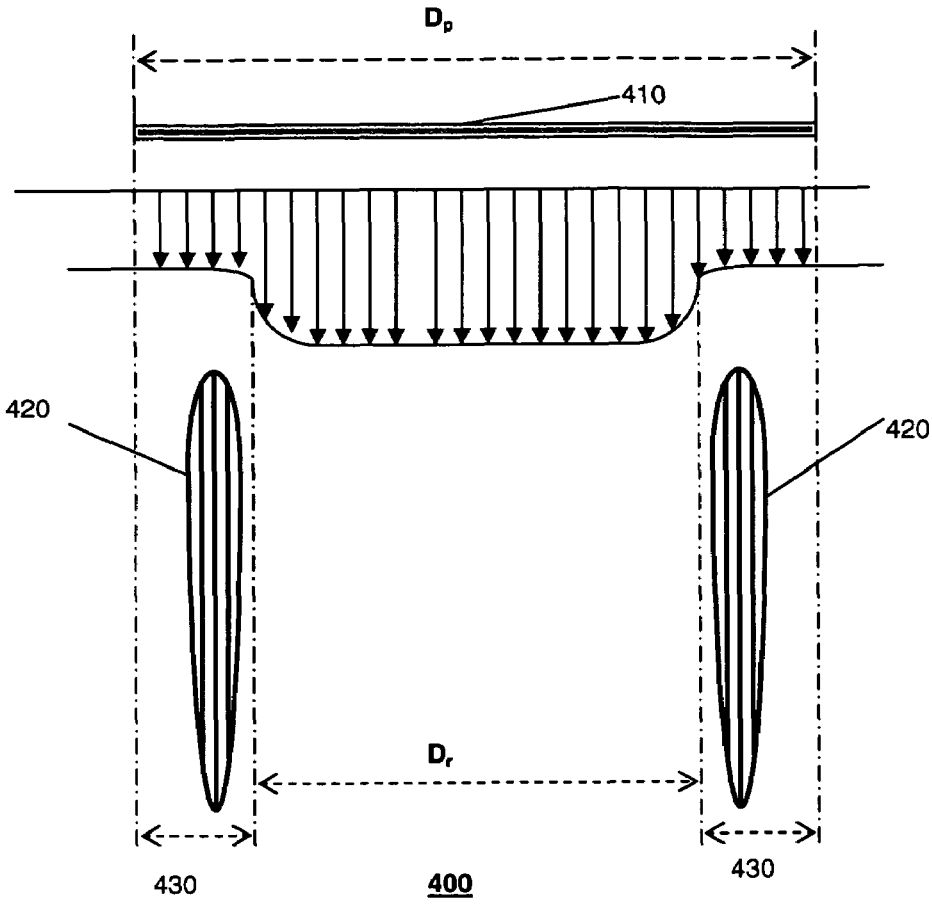
FIG. 4A is a perspective view of a steering arrangement for a high-speed water vessel in accordance with an embodiment of the present invention.
Figure 4B:
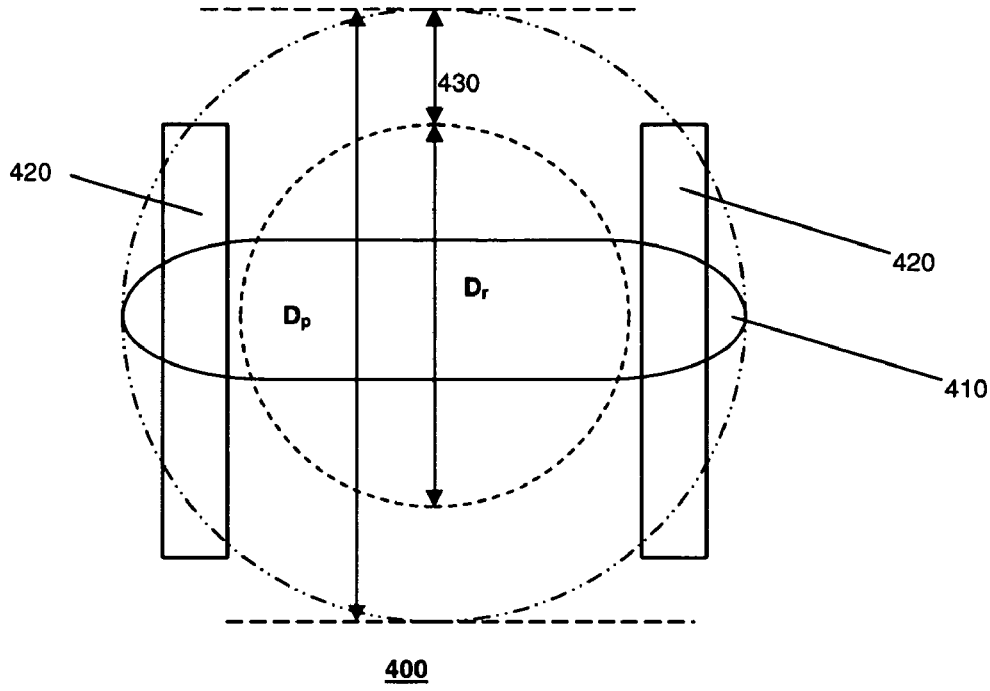
FIG. 4B is a perspective view of a steering arrangement for a high-speed water vessel in accordance with an embodiment of the present invention.

FIGS. 4A and 4B are illustrative views of a steering arrangement 400 for the high-speed water vessel in accordance with an embodiment of the present invention. Steering arrangement 400 includes a propeller 410 of a propulsor, the propeller having a propeller diameter $D_p$. The arrangement also includes rudders 420 of a rudder pair, the rudders located downstream of the propeller. FIGS. 4A and 4B illustrate $D_r$ the slipstream diameter. A zone of effectiveness 430 is illustrated as the region that extends from the outside of the slipstream diameter $D_r$ to the inner edge of the propeller diameter $D_p$. In other words, the zone of effectiveness is the region within a downstream projection of the propeller diameter, but outside the slipstream diameter profile. FIGS. 4A and 4B show the rudders 420 in an orientation for guiding the water vessel in a forward/non-turning direction. In this orientation, the rudders 420 are located in the zone of effectiveness 430. The rudders 420 are positioned within the zone of effectiveness 430 in order to reduce the effects of cavitation in high-speed applications. FIG. 4B shows the rudders being substantially parallel to each other.

According to wing theories and existing rudder design practice, a rudder can be designed to operate cavitation-free if the incoming flow velocity entering the rudder is less than 45 knots. However, in high-speed applications as detailed in equation (1), the incoming flow velocity in the slipstream exceeds 45 knots. In these applications, rudder cavitation effects can be reduced or alleviated by placing the rudder outside the slipstream. Although outside the slipstream diameter $D_r$, the rudders 420 are placed within the propeller diameter $D_p$ and adjacent to the slipstream diameter $D_r$. In the arrangement 400, the rudders 420 may be of configuration 200 or configuration 250 as illustrated in FIGS. 2A-2D.

In addition to the accelerated flow in axial direction, as stated above, the slipstream also contains large rotational and tangential velocity vectors produced by the rotating propeller. Consequently, the velocity distributions on the rudder surface facing and adjacent to the slipstream will be different from the velocity distribution on the rudder surface facing away from the slipstream. A small side force will be produced. The non-symmetrical flows on both sides of rudder surfaces, which produce greater accelerated flow on one side of rudder surface can trigger cavitation. However, the rudder configurations of FIGS. 2A-2D compensate for non-symmetrical flow by including the leading edge twist along portions of the leading edge that encounter the slipstream. The leading edge twist aligns the rudder with the flow that it encounters in arrangement 400.

Figure 4C:
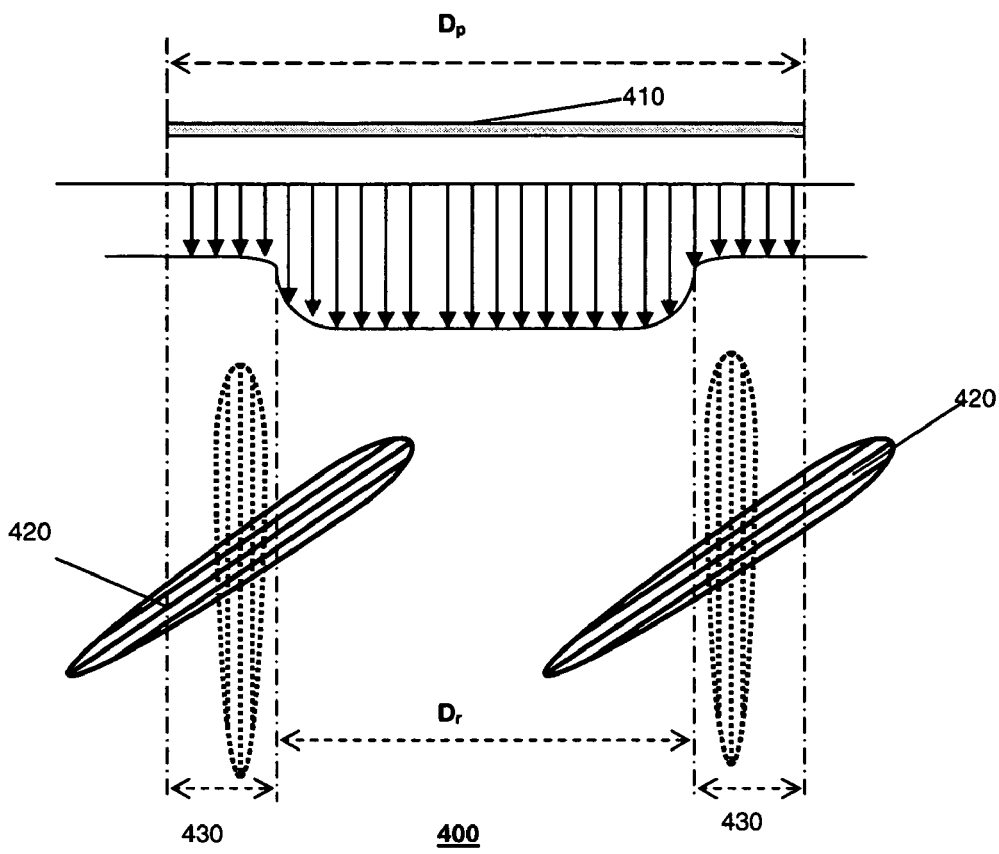
FIG. 4C is a perspective view of a steering arrangement for a high-speed water vessel in a turning orientation in accordance with an embodiment of the present invention.

FIG. 4C is an illustrative view of the steering arrangement 400 for the high-speed water vessel in accordance with an embodiment of the present invention. Similar to the illustrations in FIGS. 4A and 4B, FIG. 4C shows a propeller 410 having a propeller diameter $D_p$. The arrangement also includes rudders 420 of a rudder pair, the slipstream diameter $D_r$, and zone of effectiveness 430. FIG. 4C shows the rudders 420 in a turning configuration where portions of the rudders 420 cross the slipstream diameter boundary, and enter into the slipstream. In FIG. 4C, the dotted-line illustration of the rudder 420 depicts the rudder in the original orientation of FIGS. 4A and 4B.

When the ship executes a high-speed turning maneuver, the maneuvering control 170 sends a signal to the adjustment member 165 to rotate the rudders into the slipstream as shown in FIG. 4C. The rudders now encounter accelerated flows from the slipstream. Rudder effectiveness is proportionate to velocity squared. When the rudders encounter the high velocity slipstream, significant side forces can be produced to turn the ship effectively at all speeds. When turning is required at zero ship speed, in addition to rotating the rudders, the maneuvering control 170 initiates enough rotation of the propellers of the propulsor 130 to produce the requisite accelerated flow to execute the turning maneuver. With respect to the mechanics of turning, the rotation of the twin rudders can be linked together via a turning bar arrangement so that only the turning bar arrangement is needed to turn both rudders for steering. Alternatively, each rudder may be rotated by separate mechanisms associated with adjustment member 165 to enable independent movement between the rudders.

As stated above, the rudders discussed herein may be of configuration 200 or configuration 250 as illustrated in FIGS. 2A-2D. Additionally, the propulsor 130 may be an electrical drive system, a gas turbine engine, combinations thereof, or any other known propeller engine. When an electrical drive system is used, when backing or emergency stopping is needed, the polarity of the electric drive can be reversed to change the direction of shaft rotation and negative propeller thrust is produced to stop the water vessel. The rudder effectiveness for an electric drive propulsion system can be addressed by: (a) ability to provide directional stability of the ship in straight cruise without experiencing rudder cavitation; and (b) ability to generate adequate side force and turning moment to steer and control the craft. The rudders 200 of FIGS. 2A and 2B meet these requirements.

Figure 4D:
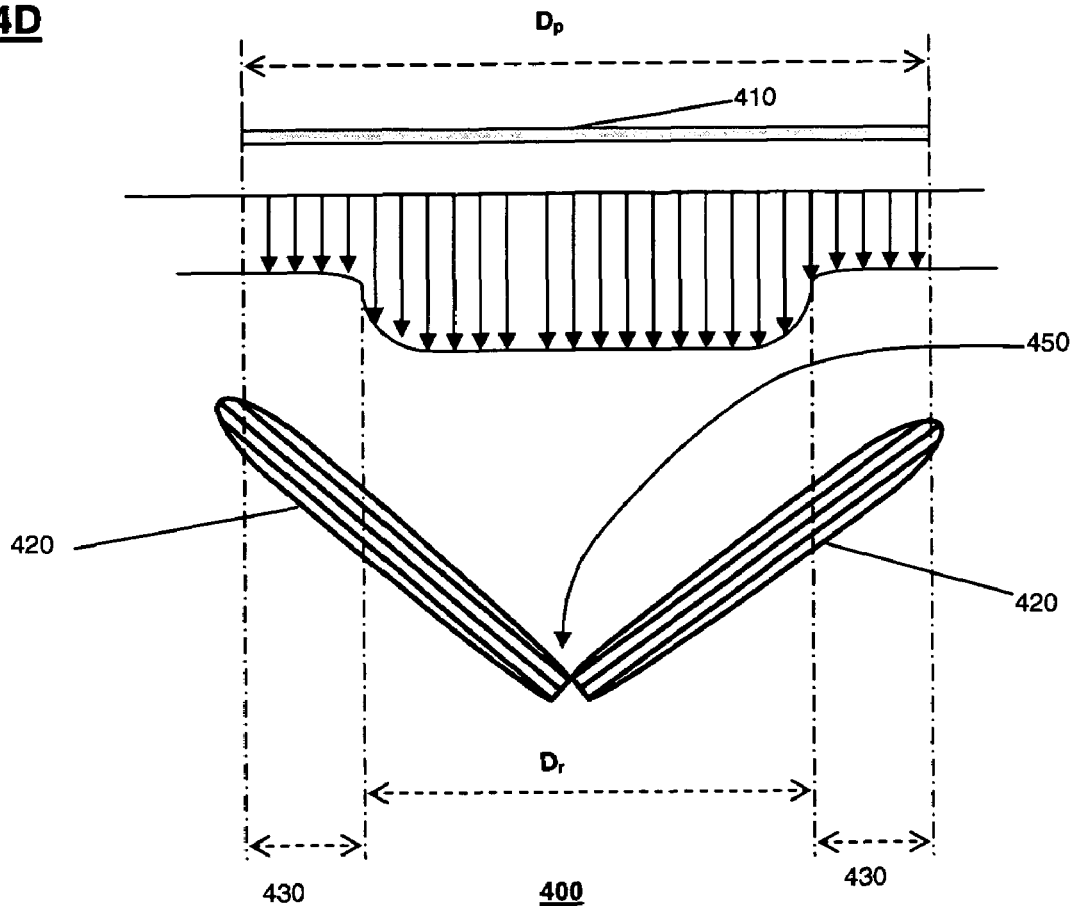
FIG. 4D is a perspective view of a steering arrangement for a high-speed water vessel in a braking or stopping orientation in accordance with an embodiment of the present invention.

Gas turbine engines, unlike electrical engines, are not reversible, and therefore the propeller is typically equipped with a controllable pitch device to generate the negative thrust forces to effect stopping. An advantage of one embodiment of the present invention is that the rudders can be used to produce large negative thrust for stopping and backing without a controllable pitch device. FIG. 4D shows the rudders 420 turned in stopping or braking orientation. When braking is required, the maneuvering control 170 may shut off the engine and/or send a signal to the adjustment member 165 to turn the rudders towards each other forming a rudder bucket 450, as shown in FIG. 4D. To increase the efficiency of this braking action, it is best to use twisted contoured rudders with blunt trailing edges, i.e., rudders of configuration 250, as illustrated in FIG. 2D. The rudders 250 of FIG. 2D provide the most effective rudder bucket. The contoured bottom 255 prevents the slipstream flow from escaping in a downward direction, the ship hull prevents slipstream flow from escaping in an upward direction, and the blunt trailing edges prevent the slipstream flow from escaping downstream of the rudder. Consequently, after contacting the rudder, the only possible outlet for the slipstream flow is the direction of entry. Therefore, all of the slipstream flow is redirected in an opposite direction, producing a negative thrust. This negative thrust can be used to stop or backup the vessel. The rotation of the each rudder of the twin rudders shown in FIG. 4D, is preferably performed by separate mechanisms associated with adjustment member 165 to enable independent movement between the rudders. Alternatively, only one turning mechanism may be associated with adjustment member to turn both rudders. It should be noted that although the braking orientation illustrated in FIG. 4D is directed to a gas turbine engine, the braking orientation may also be used with an electrical or hybrid drive system.

The rudder effectiveness for a gas turbine propulsion system can be addressed by: (a) ability to provide directional stability of the ship in straight cruise without experiencing rudder cavitation; (b) ability to generate adequate side force and turning moment to steer and control the craft; and (c) ability to produce negative thrust for stopping and backing maneuvers. The rudders 250 of FIGS. 2C and 2D meet these requirements.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A high-speed water vessel comprising:

a hull with an underside;

at least one high-speed propulsor attached to the underside of the hull, the at least one high-speed propulsor having one or more propellers, the one or more propellers having a propeller diameter, the one or more propellers generating a propeller slipstream downstream of the at least one high-speed propulsor, the slipstream having a slipstream diameter;

at least one twisted rudder pair, the at least one twisted rudder pair located downstream of the at least one high-speed propulsor, the at least one twisted rudder pair rotatably mounted within a zone of effectiveness, wherein the zone of effectiveness is the region within the downstream projection of the propeller diameter that lies outside the slipstream diameter profile; and a controller for controlling the rotation of the at least one twisted rudder pair, the controller rotating the at least one twisted rudder pair so that portions of the rudder pair rotate from a position outside the slipstream diameter to a position within the slipstream diameter.

2. The high-speed water vessel of claim 1 wherein each rudder of the at least one twisted rudder pair comprises a trailing edge and a leading edge, wherein the leading edge is twisted longitudinally at a substantially central location to accommodate for non-symmetrical slipstream flow.

3. The high-speed water vessel of claim 2 wherein the at least one propulsor is a reversible electrical engine.

4. The high-speed water vessel of claim 3 wherein the rudders of the at least one twisted rudder pair rotatably positioned within the zone of effectiveness are positioned substantially parallel to each other.

5. The high-speed water vessel of claim 4 wherein when the controller rotates the at least one twisted rudder pair so that portions of the rudder pair rotate from a position outside the slipstream diameter to a position within the slipstream diameter, a substantially parallel orientation between the rudders of the rudder pair is maintained to provide a turning function.

6. The high-speed water vessel of claim 2 wherein each rudder of the at least one rudder pair has a contoured bottom portion.

7. The high-speed water vessel of claim 6 wherein the at least one propulsor is a gas turbine engine, and wherein the rudders of the at least one twisted rudder pair rotatably positioned within the zone of effectiveness are positioned substantially parallel to each other.

8. The high-speed water vessel of claim 7 wherein when the controller rotates the at least one twisted rudder pair so that portions of the rudder pair rotate from a position outside the slipstream diameter to a position within the slipstream diameter, a substantially parallel orientation between the rudders of the rudder pair is maintained to provide a turning function.

9. The high-speed water vessel of claim 7 wherein when the controller rotates the at least one twisted rudder pair so that portions of the rudder pair rotate from a position outside the slipstream diameter to a position within the slipstream diameter, the trailing edges of the rudders of the rudder pair are rotated towards each other forming a rudder bucket to provide a negative thrust on the high-speed water vessel, and wherein the trailing edge of each rudder of the at least one twisted rudder pair has a blunt design.

10. The high-speed water vessel of claim 9 wherein the at least one gas turbine engine comprises two or more engines and the at least one twisted rudder pair comprises two or more rudder pairs.

11. A steering arrangement mounted to a high-speed ship with a hull, the arrangement comprising:

a propulsion system attached to the hull, the propulsion system having at least one high-speed propulsor having at least one propeller, the at least one propeller having a propeller diameter, the at least one propeller generating a propeller slipstream downstream of the propulsion system, the slipstream having a slipstream diameter;

at least one pair of twisted rudders rotatably attached to the hull, the at least one pair of twisted rudders positioned downstream of the at least one high-speed propulsor of the propulsion system, the at least one pair of twisted rudders positioned in a substantially parallel spaced relationship so that the pair of rudders are positioned adjacent to and outside the slipstream diameter but separated by a distance that is less than the propeller diameter.

12. The steering arrangement of claim 11 further including a controller for controlling the rotation of the at least one pair of twisted rudders, the controller rotating the at least one pair of twisted rudders so that portions of each rudder rotate from a position outside the slipstream diameter to a position within the slipstream diameter.

13. The steering arrangement of claim 12 wherein each rudder of the at least one pair of twisted rudders comprises a trailing edge and a leading edge, wherein the leading edge is twisted longitudinally along a substantially central location to accommodate for non-symmetrical slipstream flow.

14. The steering arrangement of claim 13 wherein the at least one propulsor is a reversible electrical engine.

15. The steering arrangement of claim 14 wherein when the controller rotates the at least one pair of twisted rudders so that portions of each rudder rotate from a position outside the slipstream diameter to a position within the slipstream diameter, a substantially parallel orientation between the rudders is maintained to provide a turning function.

16. The steering arrangement of claim 13 wherein the at least one propulsor is a gas turbine engine, and wherein the trailing edge of each rudder of the at least one pair of twisted rudders has a blunt design, and wherein each rudder further includes a contoured bottom portion.

17. The steering arrangement of claim 16 wherein when the controller rotates the at least one pair of twisted rudders so that portions of each rudder rotate from a position outside the slipstream diameter to a position within the slipstream diameter, a substantially parallel orientation between the rudders is maintained to provide a turning function.

18. The steering arrangement of claim 16 wherein when the controller rotates the at least one pair of twisted rudders so that portions of each rudder rotate from a position outside the slipstream diameter to a position within the slipstream diameter, the trailing edges of the rudders of the pair of rudders are rotated towards each other forming a rudder bucket to provide a braking function for the high-speed ship.

19. The steering arrangement of claim 11 wherein the propulsion system is structured to propel the high-speed ship at a speed of about 40 knots to about 55 knots.

20. The steering arrangement of claim 11 wherein the at least one high-speed propulsor comprises two or more propulsors and the at least one pair of twisted rudders comprise two or more pairs of twisted rudders.

* * * * *